US009573191B2

(12) United States Patent
Jagtap et al.

(10) Patent No.: US 9,573,191 B2
(45) Date of Patent: Feb. 21, 2017

(54) FLUID DISPENSING APPARATUS AND METHOD OF MANUFACTURE

(71) Applicant: Moen Incorporated, North Olmsted, OH (US)

(72) Inventors: Vrushant Fattesing Jagtap, Westlake, OH (US); Shun-Sheng Yang, Zhongli (TW)

(73) Assignee: Moen Incorporated, North Olmsted, OH (US)

( * ) Notice: Subject to any disclaimer, the term of this patent is extended or adjusted under 35 U.S.C. 154(b) by 62 days.

(21) Appl. No.: 14/279,643

(22) Filed: May 16, 2014

(65) Prior Publication Data

US 2014/0338777 A1 Nov. 20, 2014

Related U.S. Application Data

(60) Provisional application No. 61/824,745, filed on May 17, 2013.

(51) Int. Cl.

| | |
|---|---|
| ***B22D 19/00*** | (2006.01) |
| ***E03C 1/04*** | (2006.01) |
| ***A47K 5/12*** | (2006.01) |

(52) U.S. Cl.

CPC ..... *B22D 19/00* (2013.01); *B22D 19/0045* (2013.01); *E03C 1/0404* (2013.01); *A47K 2005/1218* (2013.01)

(58) Field of Classification Search

CPC ... B22D 19/00; B22D 19/0045; E03C 1/0404; A47K 2005/1218

USPC ..... 137/801

See application file for complete search history.

(56) References Cited

U.S. PATENT DOCUMENTS

| | | | | |
|---|---|---|---|---|
| 2,219,471 | A * | 10/1940 | Davis | F16K 1/42 137/375 |
| 2,838,816 | A | 6/1958 | Strom | |
| 3,173,451 | A | 3/1965 | Slayter | |
| 3,590,876 | A | 7/1971 | Young | |
| 3,863,701 | A | 2/1975 | Niimi et al. | |
| 4,340,018 | A | 7/1982 | Kirk | |
| 4,676,064 | A | 6/1987 | Narita et al. | |
| 4,969,263 | A | 11/1990 | Adams | |
| 5,295,529 | A | 3/1994 | Matsuo et al. | |
| 5,348,778 | A | 9/1994 | Knipp et al. | |
| 5,579,808 | A | 12/1996 | Mikol et al. | |
| 5,579,823 | A | 12/1996 | Mikol et al. | |
| 5,635,305 | A | 6/1997 | Haga et al. | |

(Continued)

FOREIGN PATENT DOCUMENTS

| | | |
|---|---|---|
| CN | 201434135 Y | 3/2010 |
| CN | 201748950 U | 2/2011 |

(Continued)

OTHER PUBLICATIONS

International Search Report for International App. No. PCT/US2014/038352 dated Oct. 8, 2014 (3 pages).

(Continued)

*Primary Examiner* — Jessica Cahill
*Assistant Examiner* — Daphne M Barry
(74) *Attorney, Agent, or Firm* — Calfee, Halter & Griswold LLP

(57) ABSTRACT

The present invention provides a fluid dispensing apparatus and a method of manufacturing a fluid dispensing apparatus.

21 Claims, 18 Drawing Sheets

(56) References Cited

U.S. PATENT DOCUMENTS

| | | | |
|---|---|---|---|
| 5,740,851 | A | 4/1998 | Haynes |
| 6,321,824 | B1 | 11/2001 | Fink et al. |
| 6,615,901 | B2 | 9/2003 | Kaminski et al. |
| 6,817,379 | B2 | 11/2004 | Perla |
| 2003/0062088 | A1 | 4/2003 | Perla |
| 2004/0117906 | A1 | 6/2004 | Baker et al. |
| 2005/0103389 | A1 | 5/2005 | Wei |
| 2009/0260153 | A1 | 10/2009 | Thomas |
| 2012/0186681 | A1 | 7/2012 | Sun et al. |
| 2012/0186768 | A1 | 7/2012 | Sun et al. |
| 2013/0299028 | A1 | 11/2013 | Gossing et al. |

FOREIGN PATENT DOCUMENTS

| | | | |
|---|---|---|---|
| CN | 202521016 | U | 11/2012 |
| CN | 202660011 | U | 1/2013 |
| CN | 202674385 | U | 1/2013 |
| EP | 0632220 | A2 | 1/1995 |

OTHER PUBLICATIONS

Written Opinion of the International Searching Authority for App. No. PCT/US2014/038352 dated Oct. 8, 2014 (6 pages).
First Office Action issued by the State Intellectual Property Office of the People's Republic of China for Chinese App. No. 201480028120.0 dated Oct. 9, 2016 (19 pages).

* cited by examiner

FLUID DISPENSING APPARATUS AND METHOD OF MANUFACTURE

CROSS-REFERENCE TO RELATED APPLICATION

This application claims the benefit of U.S. Provisional Application No. 61/824,745, filed May 17, 2013, the entire disclosure of which is hereby incorporated by reference.

FIELD

The present invention relates generally to a fluid dispensing apparatus and a method of manufacturing a fluid dispensing apparatus.

BACKGROUND

Fluid dispensing apparatuses, such as faucets and soap dispensers, are well known. Such fluid dispensing apparatuses are used in residential and commercial applications, such as in kitchens, bathrooms, and various other locations.

Fluid dispensing apparatuses are manufactured using many different techniques. One of these techniques is casting. The manufacture of fluid dispensing apparatuses using casting poses many difficulties.

SUMMARY

The present invention provides a fluid dispensing apparatus. In an exemplary embodiment, the fluid dispensing apparatus comprises a core and a shell. The core is formed from a metal alloy. The core metal alloy has a melting point. The core has an inner surface and an outer surface. The core has an inlet and an outlet. The core has a passageway extending from the inlet to the outlet. The shell is formed from a metal alloy. The shell metal alloy has a melting point. The shell is cast around the outer surface of the core. The melting point of the core metal alloy is approximately the same as the melting point of the shell metal alloy.

In another exemplary embodiment, the fluid dispensing apparatus comprises a core and a shell. The core is formed from a metal alloy. The core metal alloy has a ductility. The core includes a unitary bent tube. The core has an inner surface and an outer surface. The core has an inlet and an outlet. The core has a passageway extending from the inlet to the outlet. The shell is formed from a metal alloy. The shell is cast around the outer surface of the core. The ductility of the core metal alloy enables the tube to be bent.

The present invention provides a method of manufacturing a fluid dispensing apparatus. In an exemplary embodiment, the method comprises the steps of forming a core and casting a shell. The core is formed from a metal alloy. The core metal alloy has a melting point. The core has an inner surface and an outer surface. The core has an inlet and an outlet. The core has a passageway extending from the inlet to the outlet. The shell is cast around the outer surface of the core. The shell is formed from a metal alloy. The shell metal alloy has a melting point. The melting point of the core metal alloy is approximately the same as the melting point of the shell metal alloy.

In another exemplary embodiment, the method comprises the steps of forming a core and casting a shell. The core is formed from a metal alloy. The core metal alloy has a ductility. The core is formed by bending a unitary tube. The core has an inner surface and an outer surface. The core has an inlet and an outlet. The core has a passageway extending from the inlet to the outlet. The shell is cast around the outer surface of the core. The shell is formed from a metal alloy. The ductility of the core metal alloy enables the tube to be bent.

BRIEF DESCRIPTION OF THE DRAWINGS

FIGS. 1*a*-1*e* are views of a faucet including a core and a shell according to a first exemplary embodiment of the present invention, the core including a first core half and a second core half—FIG. 1*a* is a view of the first core half and the second core half prior to assembly, FIG. 1*b* is a view of the assembled core, FIG. 1*c* is a view of the core and the shell after the shell has been die cast around the core, FIG. 1*d* is a view of the faucet after finishing, and FIG. 1*e* is a view of a cross-section of the faucet after finishing;

—FIG. 2*a* is a view of the first core half and the second core half prior to assembly, FIG. 2*b* is a view of the assembled core, FIG. 2*c* is a view of the core and the shell after the shell has been die cast around the core, FIG. 2*d* is a view of the soap dispenser after finishing, and FIG. 2*e* is a view of a cross-section of the soap dispenser after finishing;

—FIG. 3*a* is a view of the first core half and the second core half prior to assembly, FIG. 3*b* is a view of the assembled core, FIG. 3*c* is a view of the core and the shell after the shell has been die cast around the core, FIG. 3*d* is a view of the faucet after finishing, and FIG. 3*e* is a view of a cross-section of the faucet after finishing;

—FIG. 4*a* is a view of the bent tube, FIG. 4*b* is a view of the core and the shell after the shell has been die cast around the core, FIG. 4*c* is a view of the faucet after finishing, and FIG. 4*d* is a view of a cross-section of the faucet after finishing;

—FIG. 5*a* is a view of the soap dispenser after finishing and FIG. 5*b* is a view of a cross-section of the soap dispenser after finishing;

DETAILED DESCRIPTION

Figure 1A:
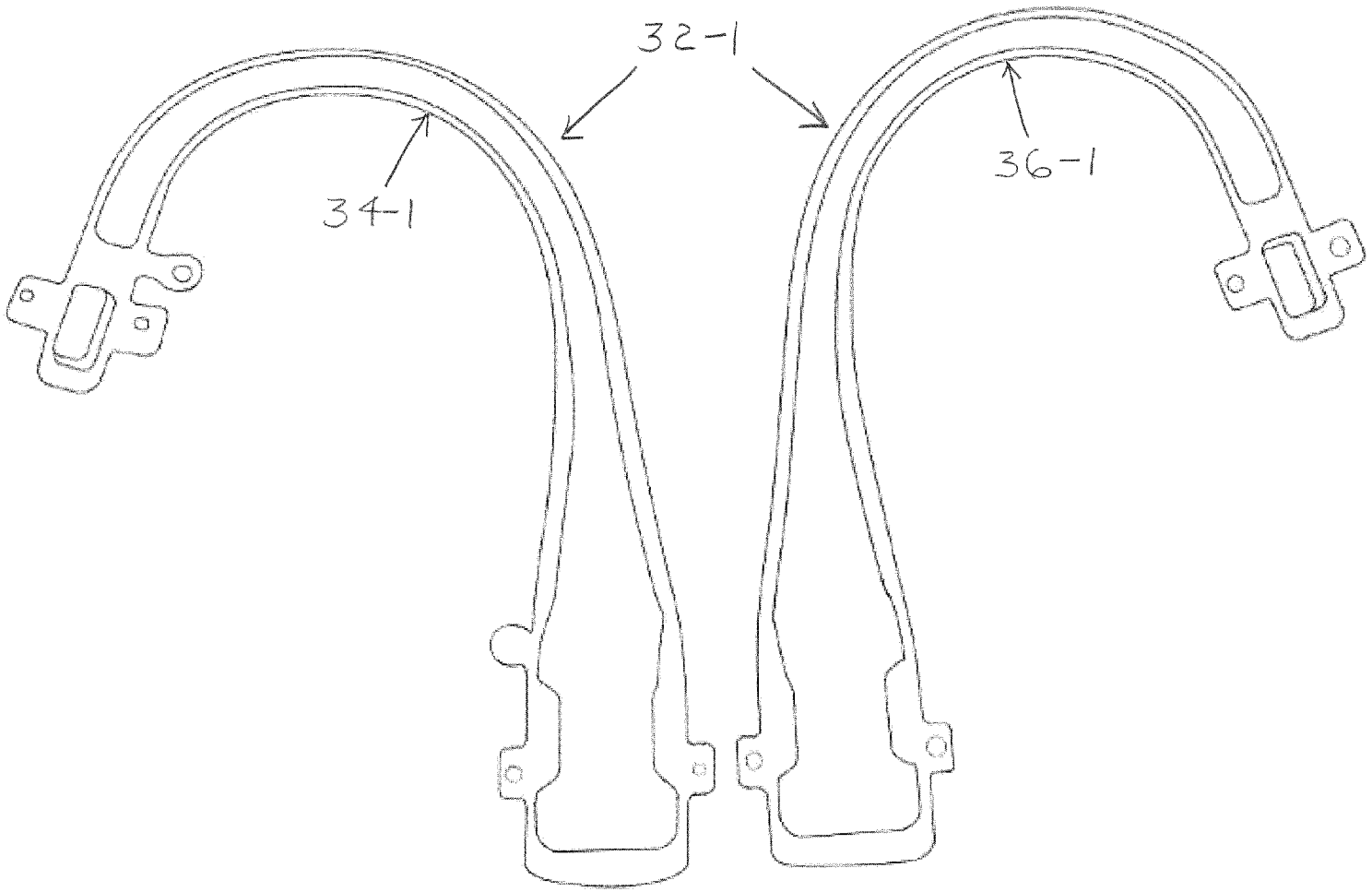
Figure 1B:
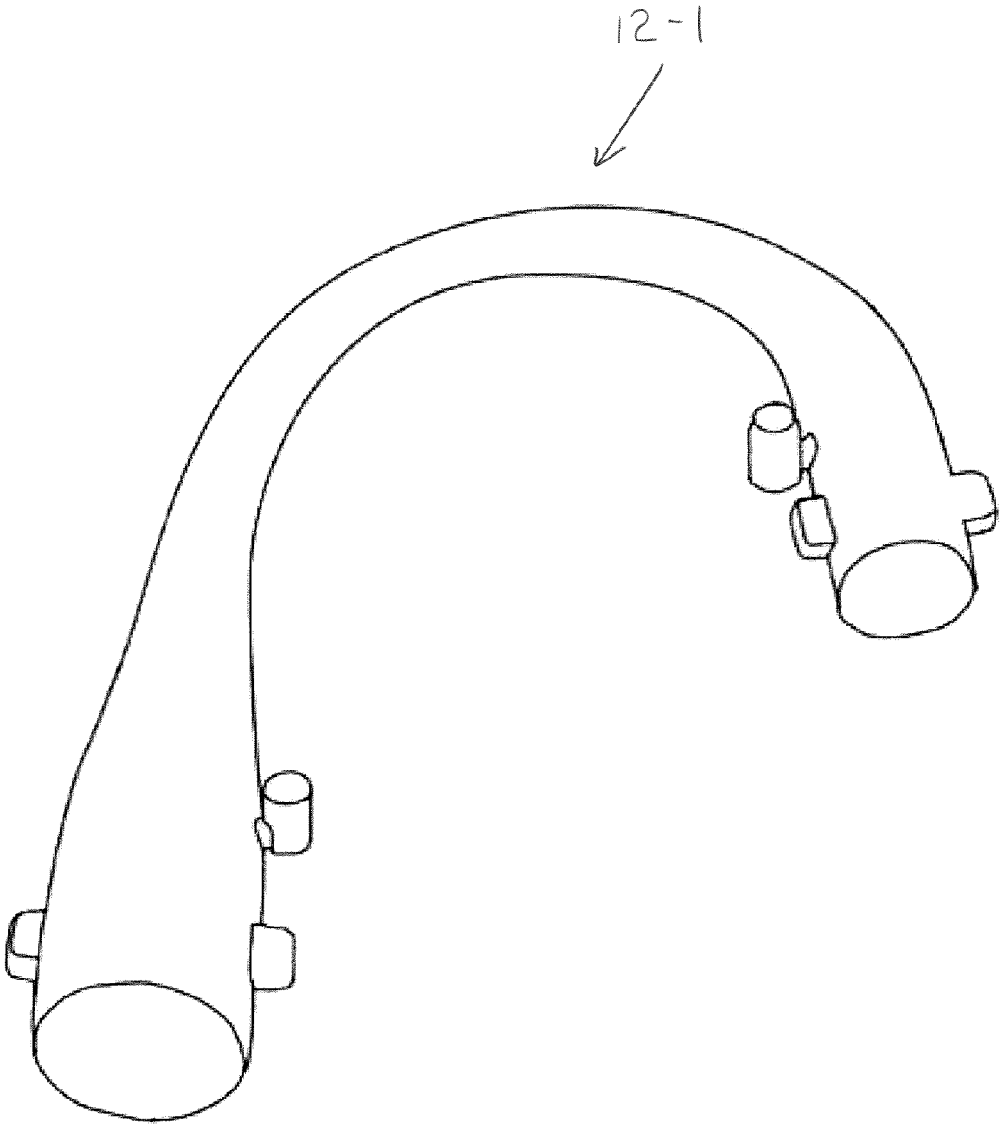
Figure 1C:
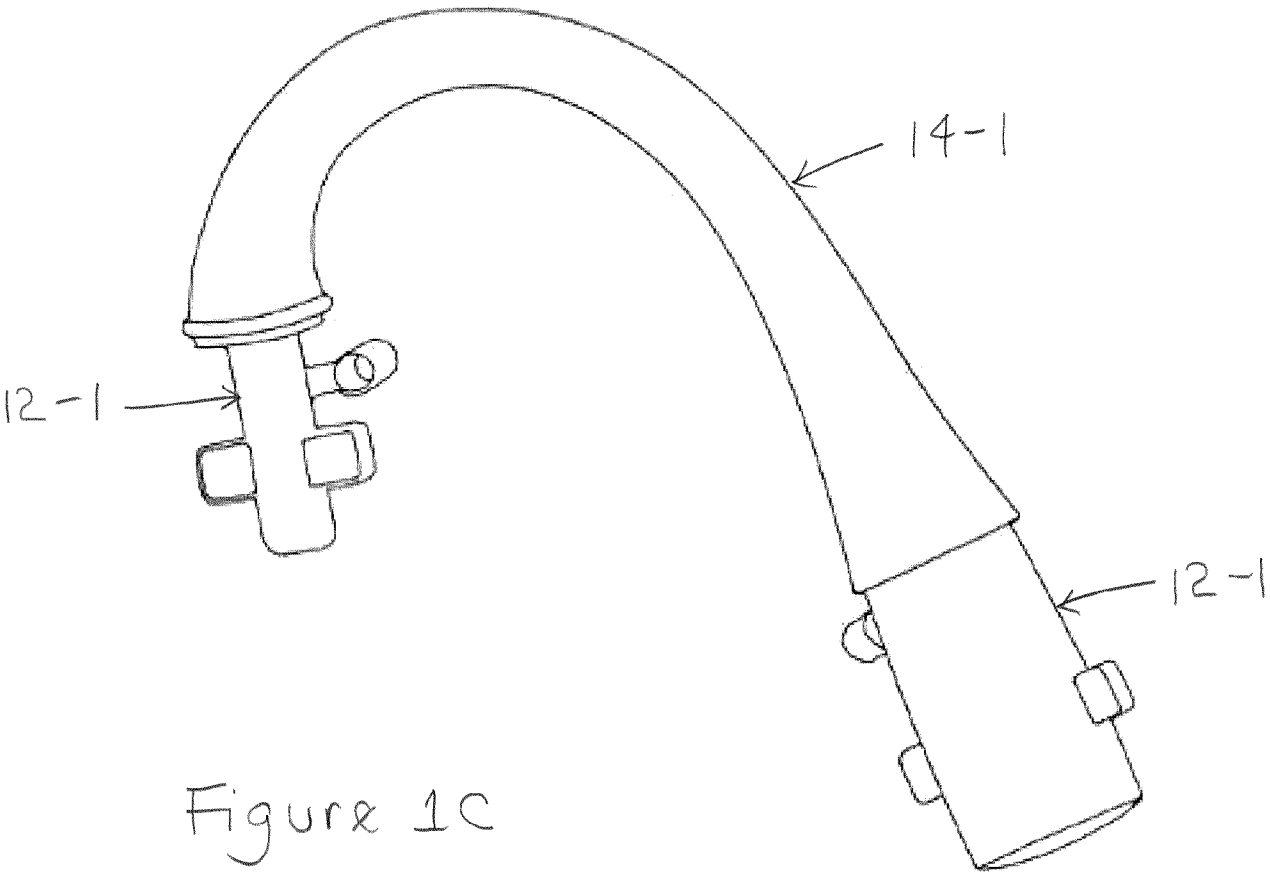
Figure 1C:
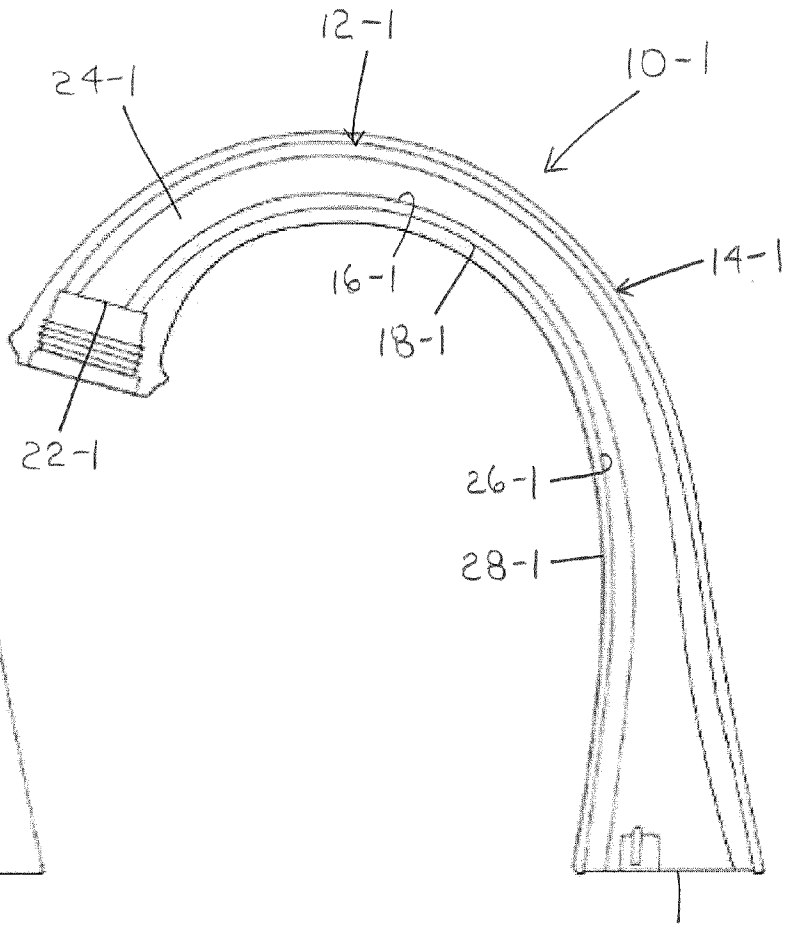
Figure 1D:
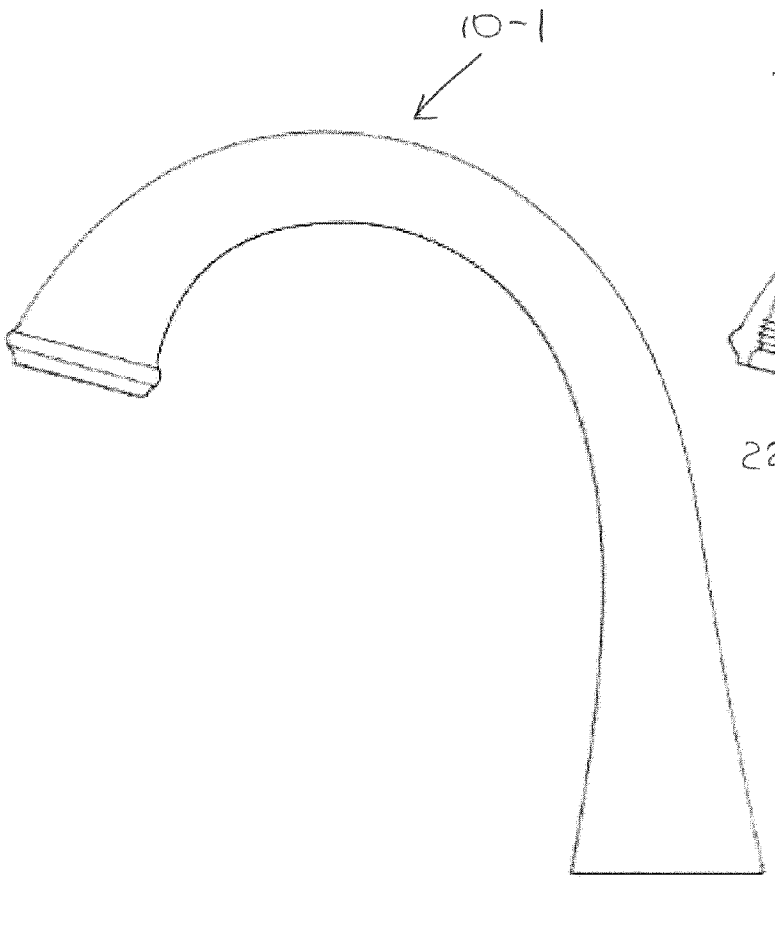
Figure 2A:
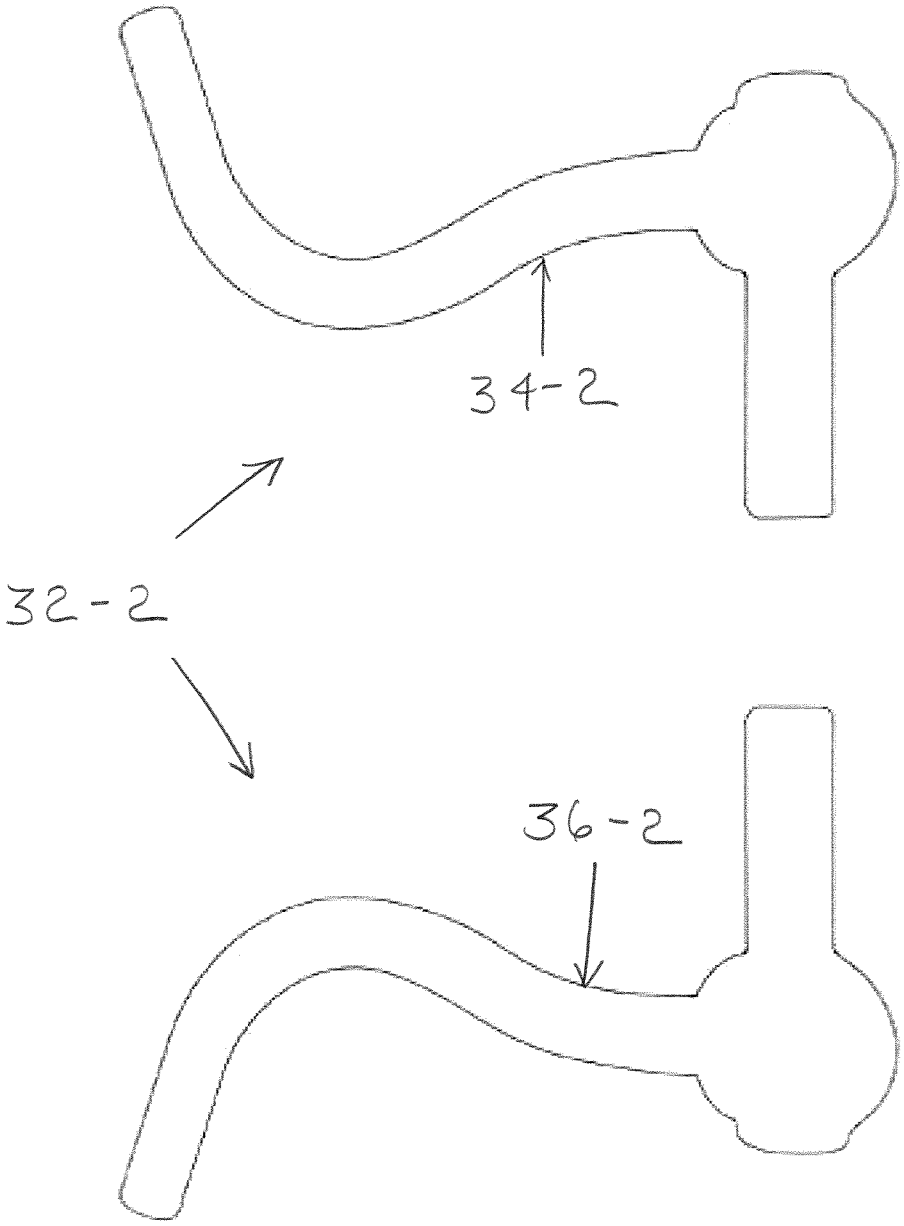
FIGS. 2*a*-2*e* are views of a soap dispenser including a core and a shell according to a second exemplary embodiment of the present invention, the core including a first core half and a second core half
Figure 2B:
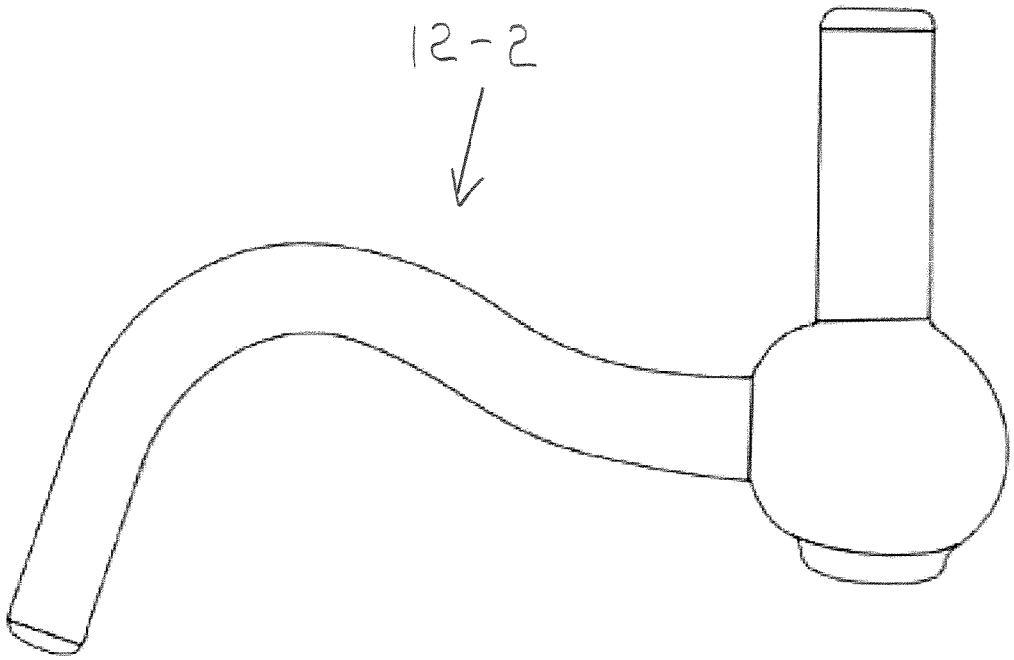
Figure 2C:
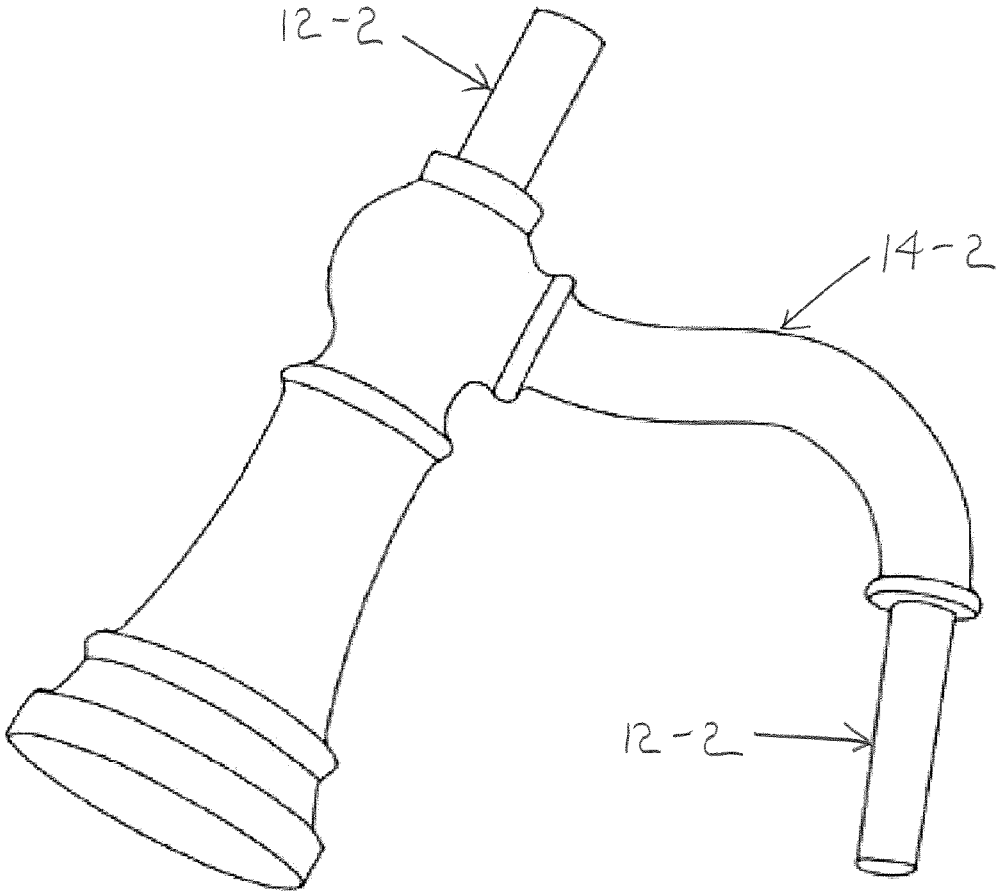
Figure 2D:
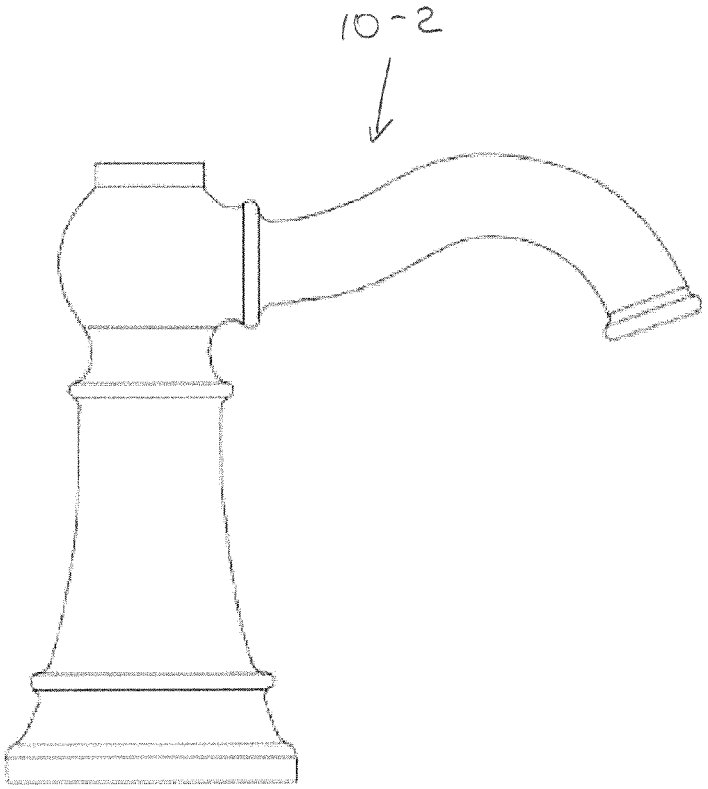
Figure 2E:
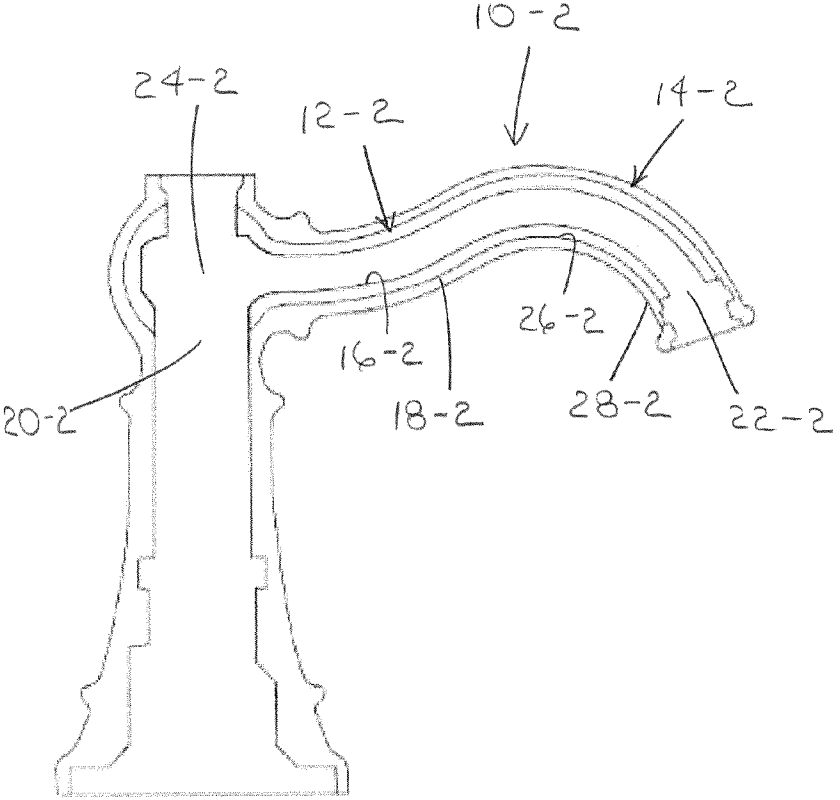
Figure 3A:
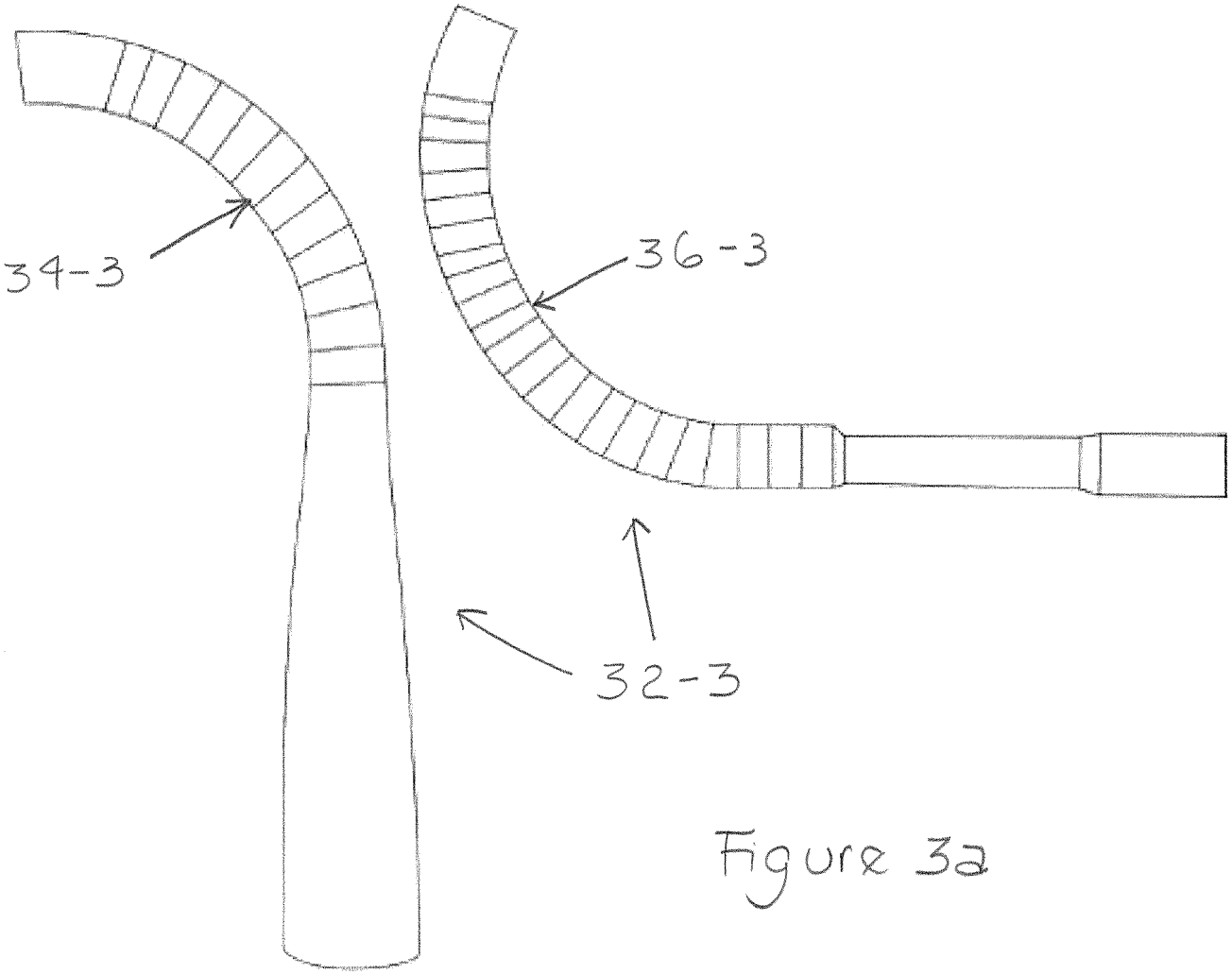
FIGS. 3*a*-3*e* are views of a faucet including a core and a shell according to a third exemplary embodiment of the present invention, the core including a first core half and a second core half
Figure 3B:
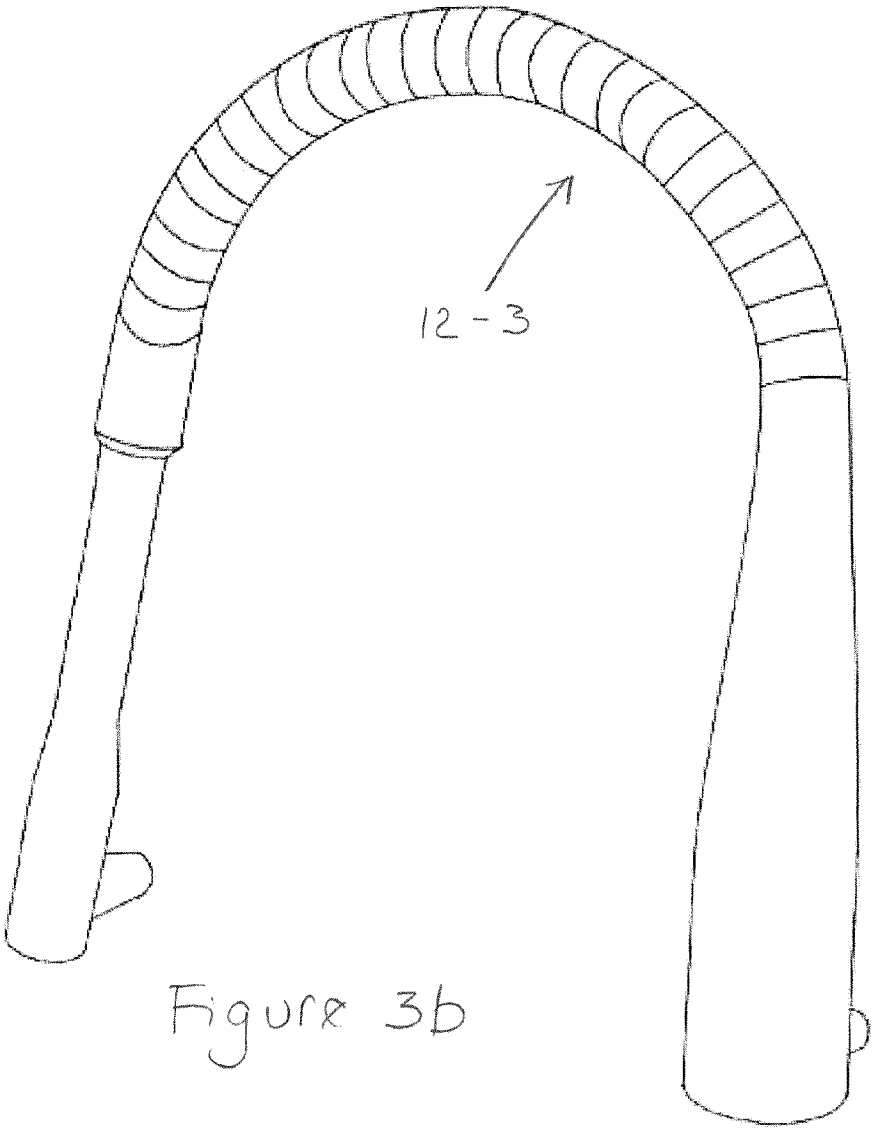
Figure 3C:
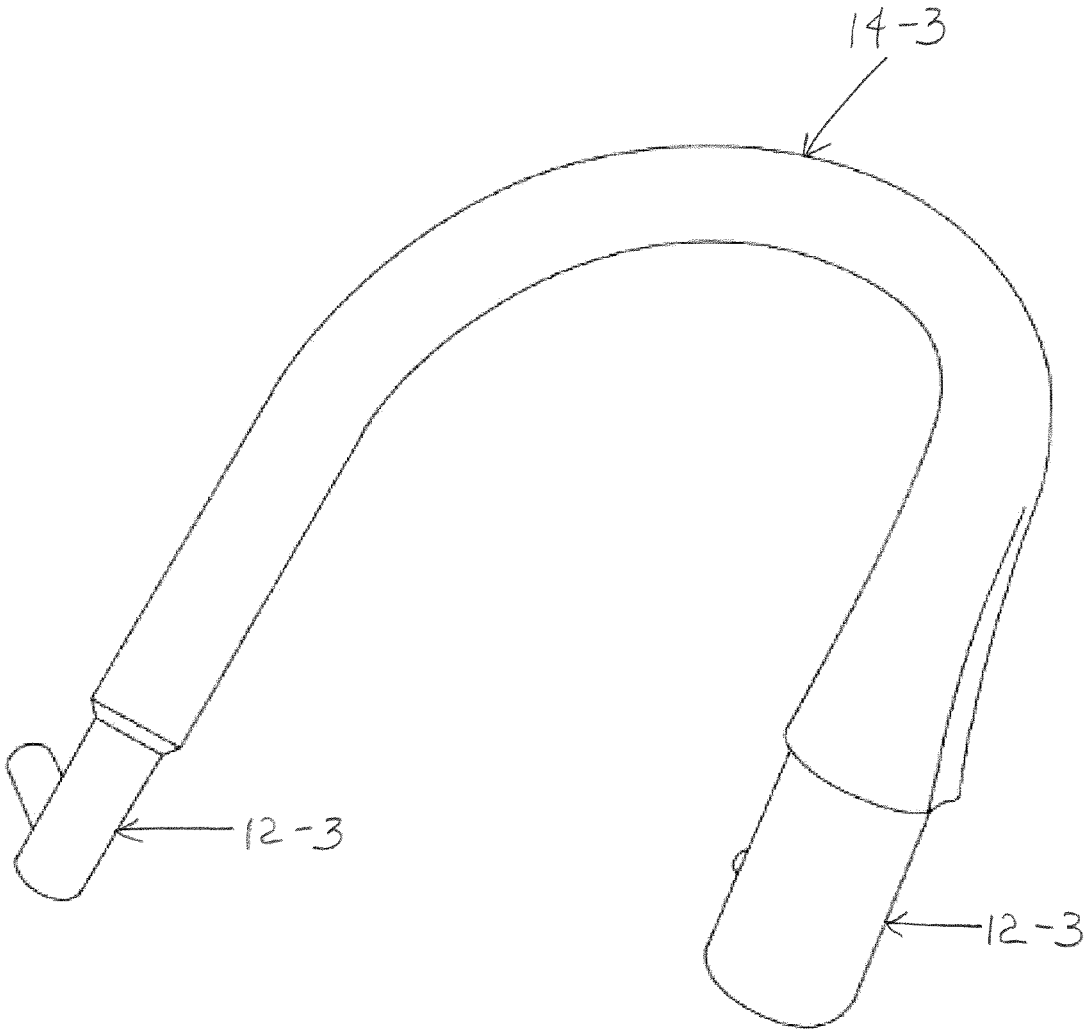
Figure 3D:
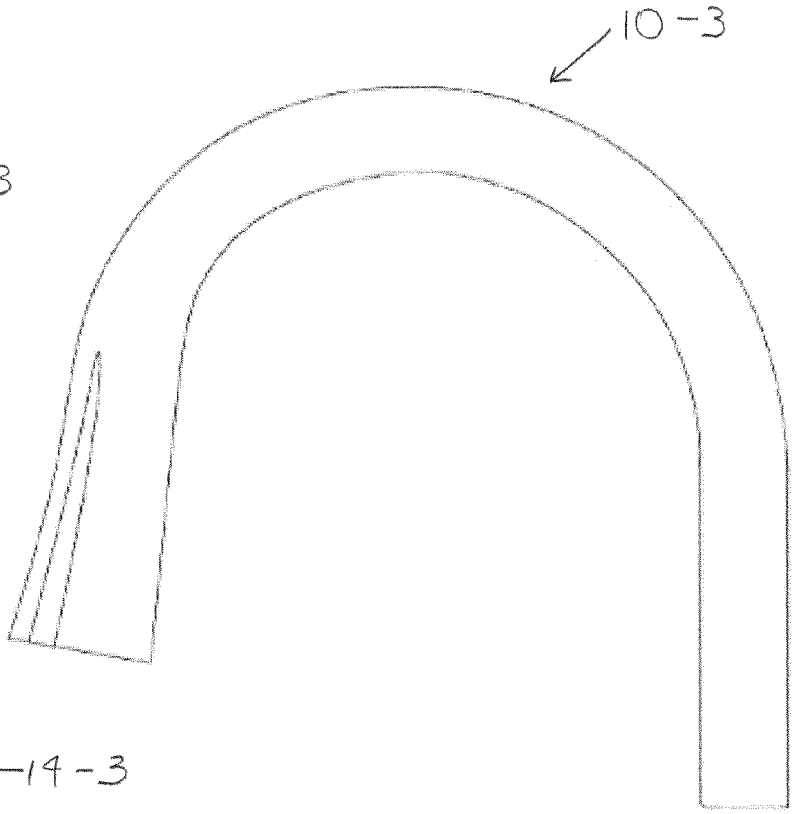
Figure 3E:
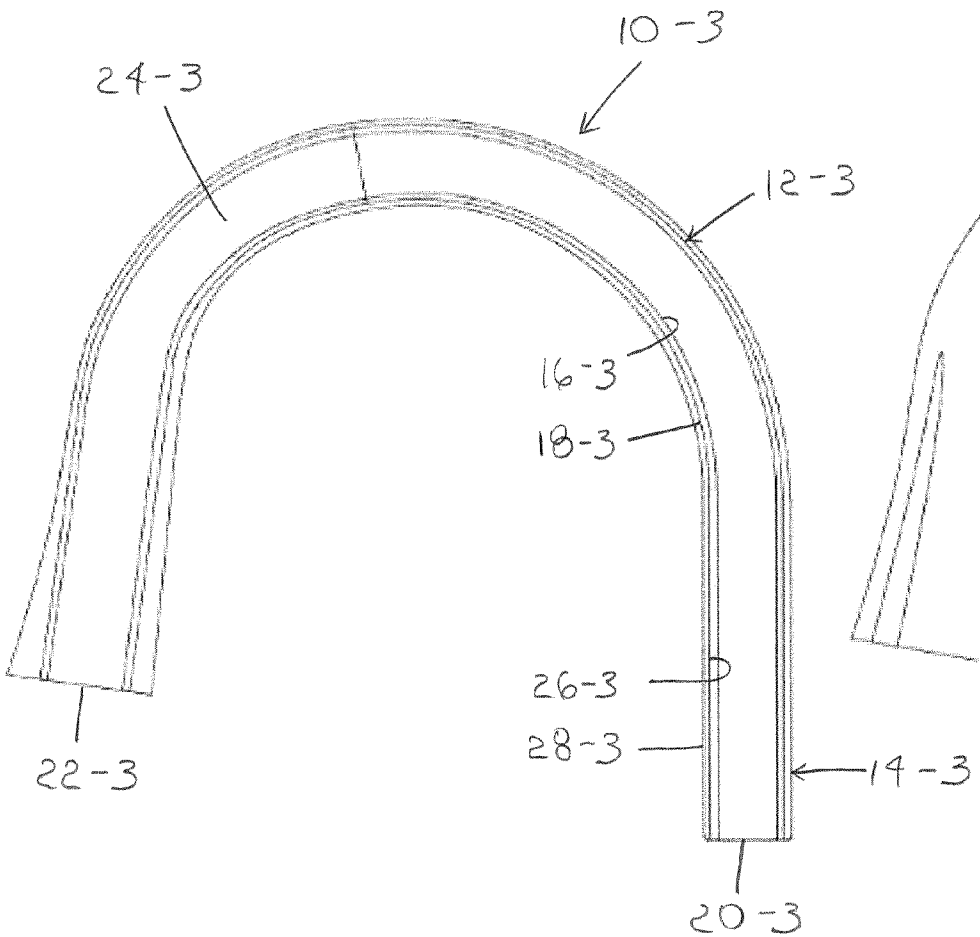
Figure 4A:
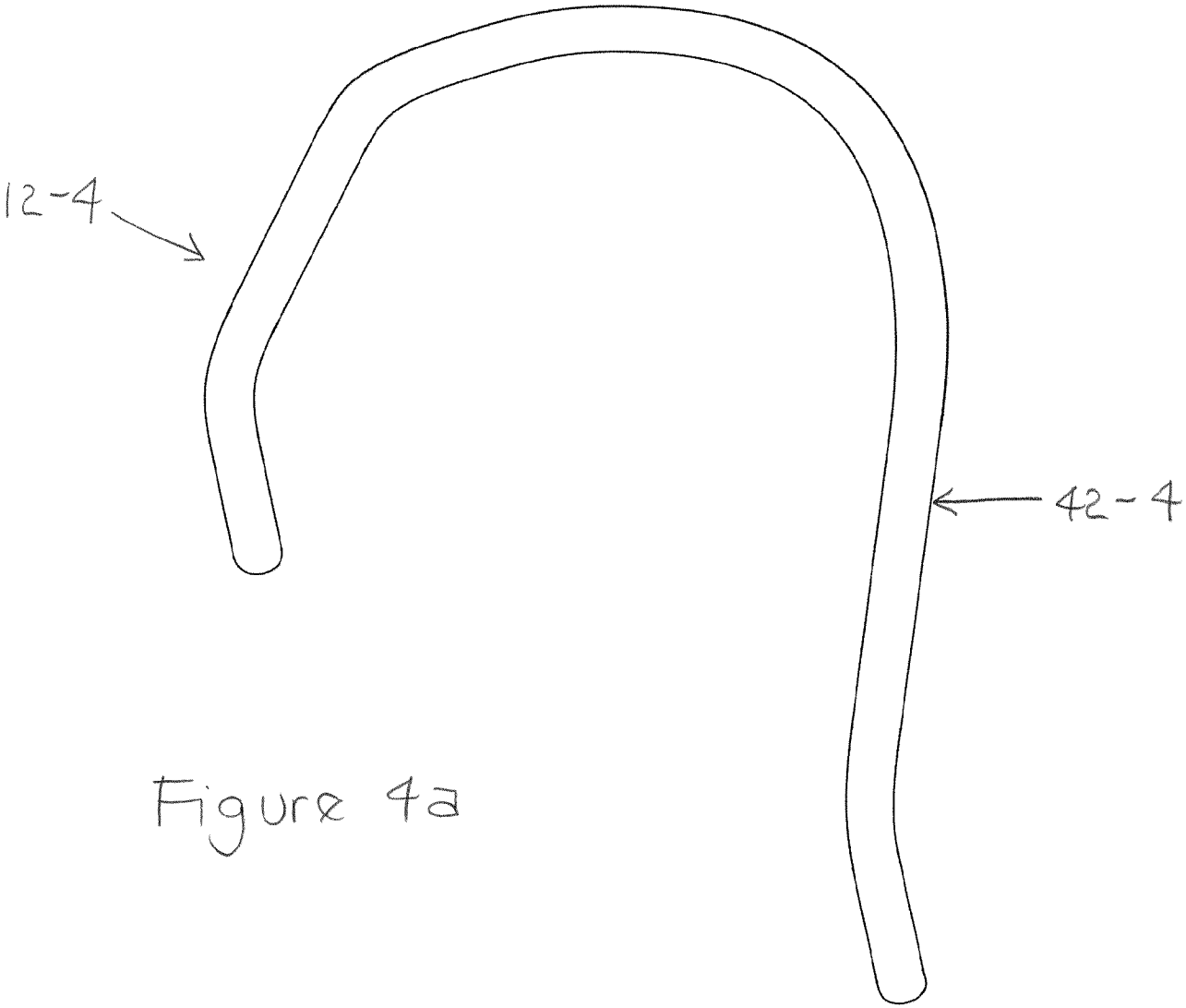
FIGS. 4*a*-4*d* are views of a faucet including a core and a shell according to a fourth exemplary embodiment of the present invention, the core including a bent tube
Figure 4B:
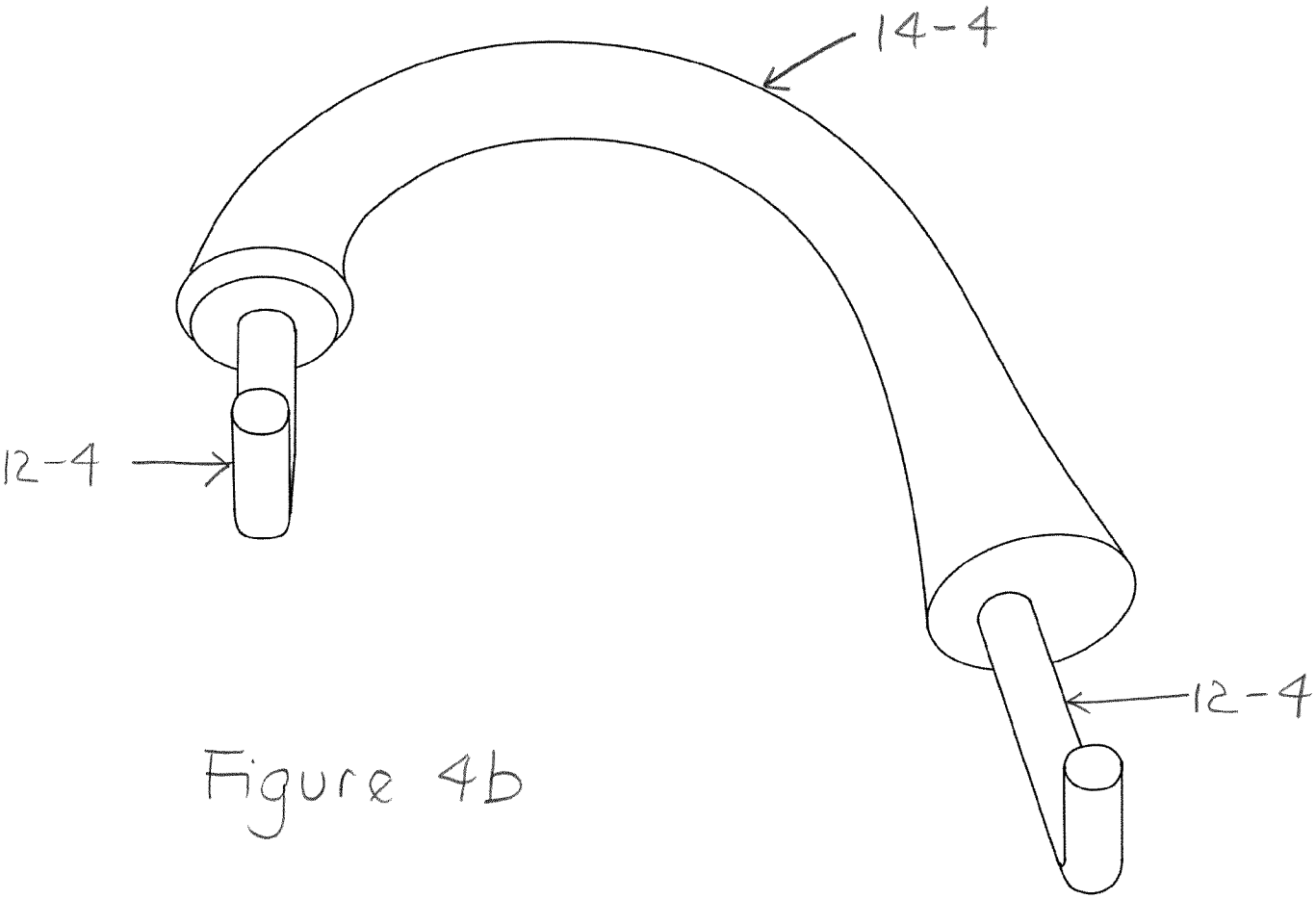
Figure 4D:
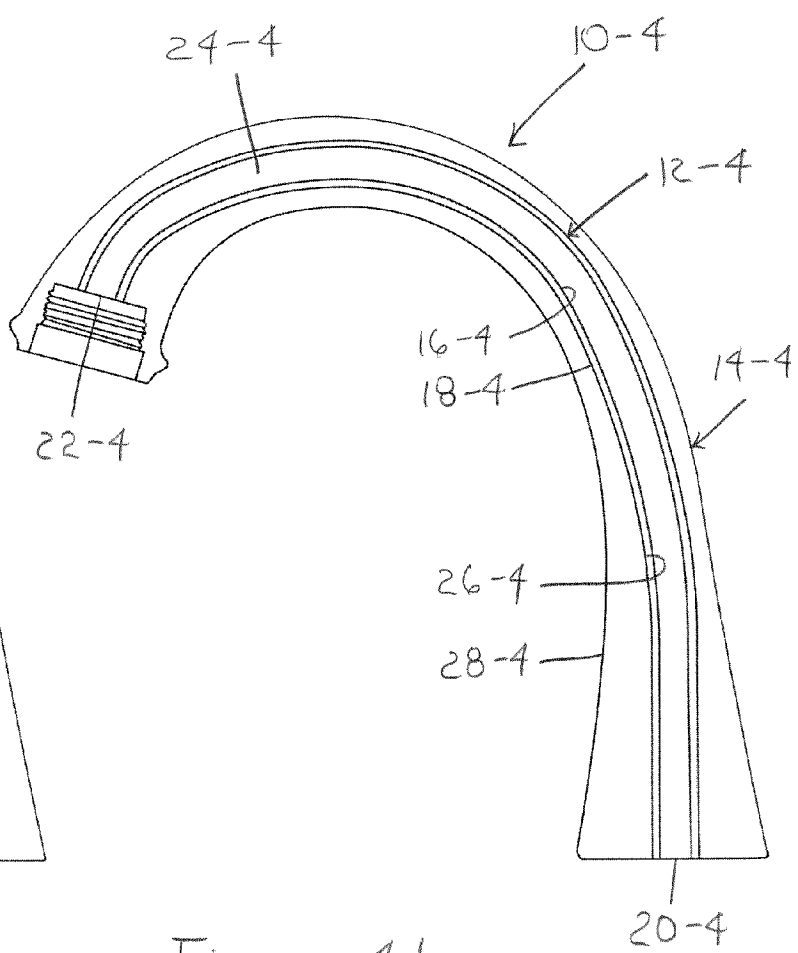
Figure 4C:
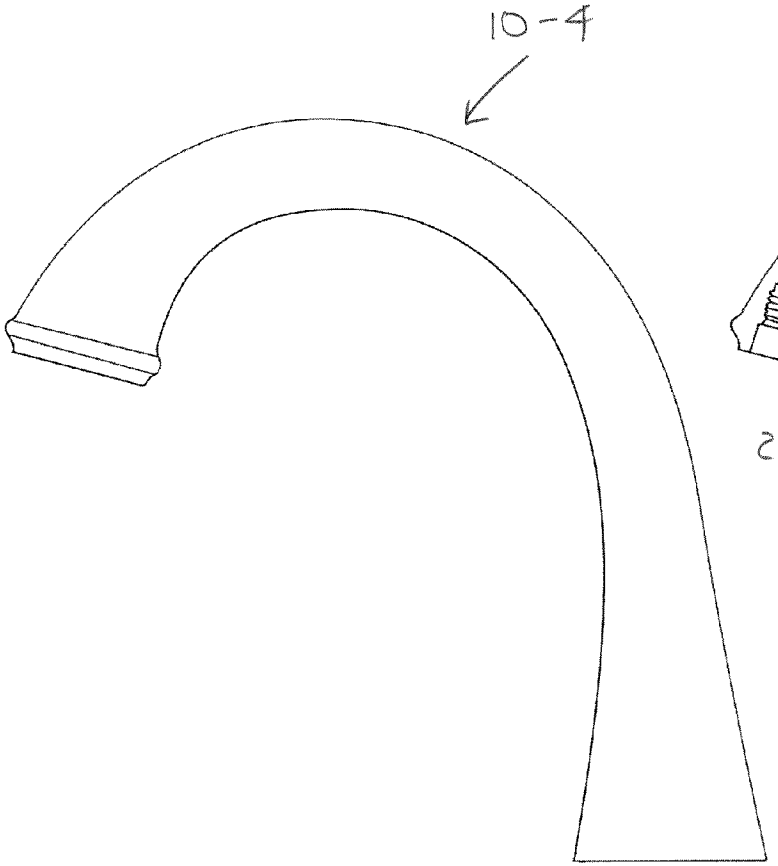

The present invention provides a fluid dispensing apparatus and a method of manufacturing a fluid dispensing apparatus. In an exemplary embodiment, the fluid dispensing apparatus is a faucet. However, one of ordinary skill in the art will appreciate that the fluid dispensing apparatus could be a showerhead, a handheld shower, a body spray, a side spray, or any other plumbing fixture fitting. In another exemplary embodiment, the fluid dispensing apparatus is a soap dispenser.

Throughout the detailed description and the drawings, each similar component of the fluid dispensing apparatus will be referred to using the same reference number with the suffix "-X" indicating a generic embodiment of the component of the fluid dispensing apparatus and the suffix "-#" indicating a specific embodiment of the component of the fluid dispensing apparatus.

Exemplary embodiments of a fluid dispensing apparatus 10-X are illustrated in FIGS. 1*a*-1*e*, 2*a*-2*e*, 3*a*-3*e*, 4*a*-4*d*, and 5*a*-5*b*. In the exemplary embodiments, the fluid dispensing apparatus 10-X includes a core 12-X and a shell 14-X.

The core 12-X is formed from a metal alloy. The core 12-X has an inner surface 16-X and an outer surface 18-X. The core 12-X has an inlet 20-X and an outlet 22-X. The core 12-X has a passageway 24-X extending from the inlet 20-X to the outlet 22-X.

The shell 14-X is formed from a metal alloy. The shell 14-X is cast around the outer surface 18-X of the core 12-X. In exemplary embodiments, the shell 14-X is cast using pressure die casting or low pressure permanent mold casting. The shell 14-X has an inner surface 26-X and an outer surface 28-X.

In an exemplary embodiment, the fluid dispensing apparatus 10-X includes a liner 30-X. The liner 30-X is operable to prevent fluid flowing through the passageway 24-X of the core 12-X from contacting the inner surface 16-X of the core 12-X. In an exemplary embodiment, the liner 30-X is formed from a flexible material. In an exemplary embodiment, the liner is formed from a non-metal. In an exemplary embodiment, the liner 30-X is operable to be inserted in the passageway 24-X of the core 12-X. In an exemplary embodiment, the liner 30-X is operable to be applied to the inner surface 16-X of the core 12-X.

The core metal alloy has a melting point, and the shell metal alloy has a melting point. In an exemplary embodiment, the melting point of the core metal alloy is approximately the same as the melting point of the shell metal alloy.

Although the core metal alloy and the shell metal alloy have been described as having a melting point, one of ordinary skill in the art will appreciate that the melting point is not a discrete temperature, but includes a range of temperatures between a solidus and a liquidus. The solidus is the temperature below which a substance is completely solid. The liquidus is the temperature above which a substance is completely liquid. The melting range of temperatures between the solidus and the liquidus are the temperatures at which a substance is a mixture of solid and liquid. A melting point of one metal alloy is approximately the same as the melting point of another metal alloy if the melting range of the one metal alloy overlaps the melting range of the other metal alloy.

In an exemplary embodiment, the solidus of the core 12-X is within fifty degrees Fahrenheit (50° F.) of the solidus of the shell 14-X.

In an exemplary embodiment, the solidus of the core 12-X is within one hundred degrees Fahrenheit (100° F.) of the liquidus of the shell 14-X.

In an exemplary embodiment, the core 12-X includes one or more core components 32-X. Each core component 32-X is cast. In exemplary embodiments, each core component 32-X is cast using pressure die casting or low pressure permanent mold casting.

In an exemplary embodiment, the core 12-X includes a unitary core component 32-X. In an exemplary embodiment, the core 12-X includes a plurality of core components 32-X. The plurality of core components 32-X are operable to be joined together to form the core 12-X. The plurality of core components 32-X are joined together using any known technique such that the shell 14-X does not penetrate the passageway 24-X of the core 12-X when the shell 14-X is cast around the core 12-X.

In an exemplary embodiment, the core 12-X is formed from a first core half 34-X and a second core half 36-X. In an exemplary embodiment, the first core half 34-X and the second core half 36-X are mirror images of each other. In an exemplary embodiment, the first core half 34-X and the second core half 36-X are not mirror images of each other.

Figure 6:
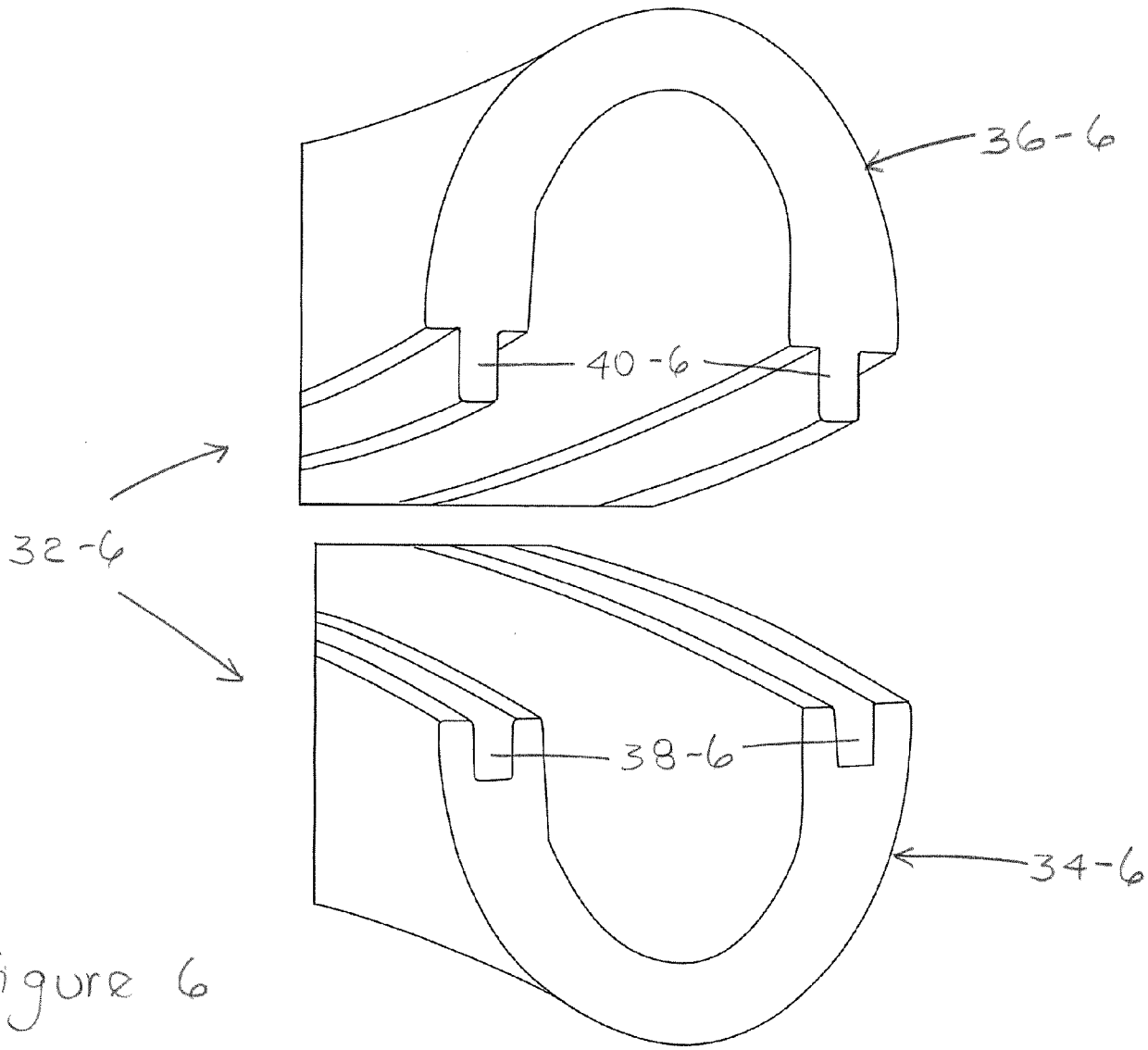
FIG. 6 is a view of a cross-section of portions of a core according to an exemplary embodiment of the present invention, the core including a first core half and a second core half, the first core half including a groove and the second core half including a tongue.

In an exemplary embodiment, such as shown in FIG. 6, the first core half 34-X includes a groove 38-X (such as groove 38-6 in first core half 34-6), and the second core half 36-X includes a tongue 40-X (such as tongue 40-6 in second core half 36-6). The groove 38-X of the first core half 34-X is operable to receive the tongue 40-X of the second core half 36-X to join together the first core half 34-X and the second core half 36-X.

In an exemplary embodiment, the core components 32-X are formed from a zinc alloy or an aluminum alloy, and the shell 14-X is formed from a zinc alloy or an aluminum alloy. Exemplary zinc alloys include Zamak 2, Zamak 3, Zamak 5, Zamak 7, ZA-8, ZA-12, ZA-27, and ACuZinc. Exemplary aluminum alloys include 242, 319, 360, 362, 380, A380, B380, 384, 390, 413, and 712.

In an exemplary embodiment, the core 12-X includes a bent tube 42-X. In an exemplary embodiment, the core 12-X is formed by bending a unitary straight tube. The core metal alloy has a ductility. In an exemplary embodiment, the ductility of the core metal alloy enables the tube 42-X to be bent. In an exemplary embodiment, the tube 42-X is hydroformed after it is bent.

In an exemplary embodiment, the tube 42-X is formed from a copper alloy or a stainless steel. Exemplary copper alloys include copper, brass, bronze, red brass, yellow brass, silicon bronze, aluminum bronze, and manganese bronze. Exemplary stainless steel include 300 series stainless steel, such as types 301, 302, 303, 304, 304L, 308, 310, 316, and 321. In an exemplary embodiment, the shell 14-X is formed from a zinc alloy or an aluminum alloy. Again, exemplary zinc alloys include Zamak 2, Zamak 3, Zamak 5, Zamak 7, ZA-8, ZA-12, ZA-27, and ACuZinc. Exemplary aluminum alloys include 242, 319, 360, 362, 380, A380, B380, 384, 390, 413, and 712.

In an exemplary embodiment, the core 12-X has a thickness L, and the shell 14-X has a thickness L. In an exemplary embodiment, around a substantial portion of the outer surface 18-X of the core 12-X, the thickness $t_s$ of the shell 14-X is less than the thickness $t_c$ of the core 12-X. In an exemplary embodiment, around a substantial portion of the outer surface 18-X of the core 12-X, the thickness $t_s$ of the shell 14-X is approximately the same as the thickness $t_c$ of the core 12-X. In an exemplary embodiment, a substantial portion means at least twenty percent (20%). In an exemplary embodiment, a substantial portion means at least thirty percent (30%). In an exemplary embodiment, a substantial portion means at least fifty percent (50%).

In an exemplary embodiment, the core 12-X has a microstructure, and the shell 14-X has a microstructure. In an exemplary embodiment, the microstructure of the shell 14-X is finer grained than the microstructure of the core 12-X.

In an exemplary embodiment, the shell 14-X has the outer surface 28-X. In an exemplary embodiment, the outer surface 28-X of the shell 14-X is substantially free from voids.

Figure 7:
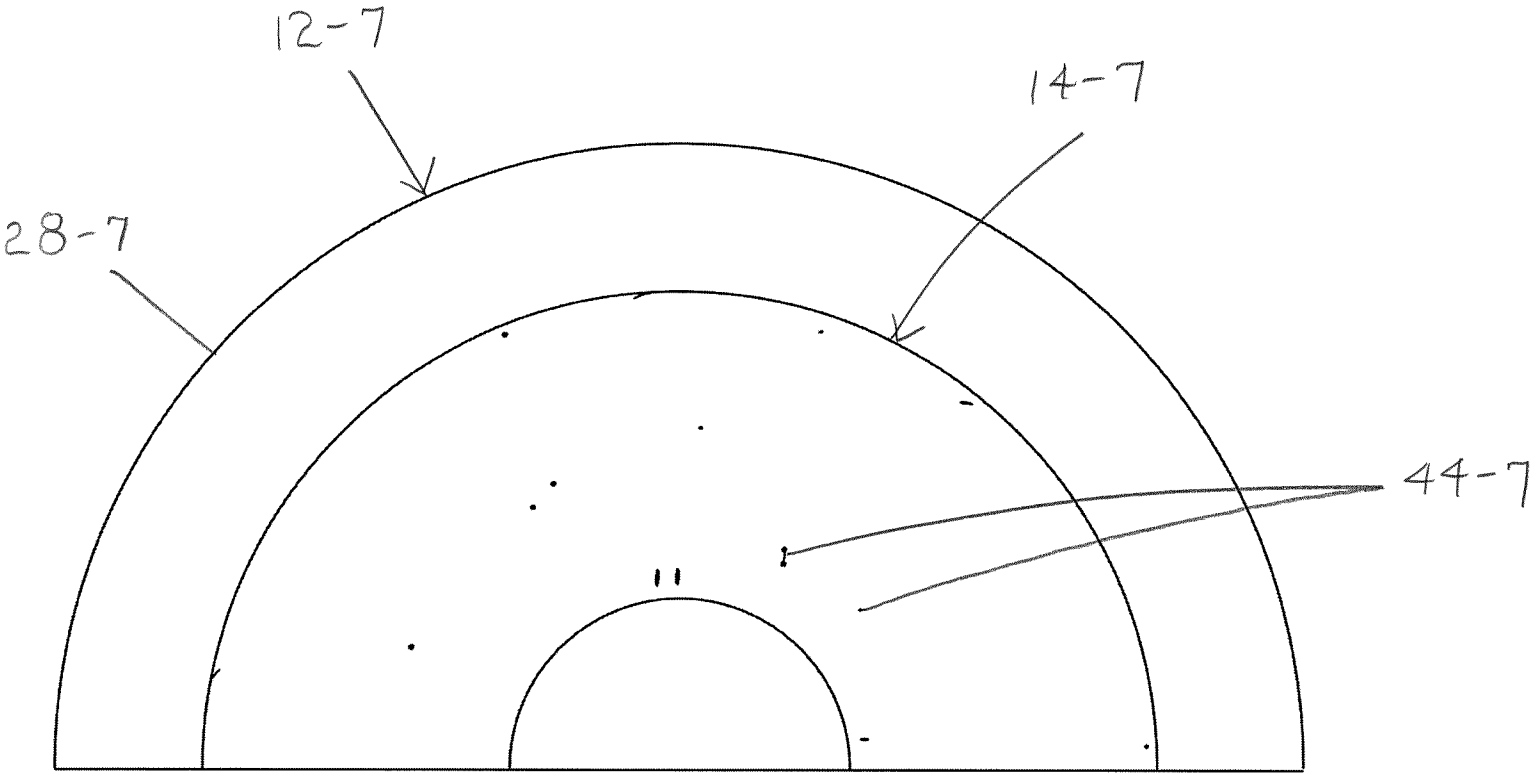
FIG. 7 is a view of a cross-section of a portion of a core and a shell according to an exemplary embodiment of the present invention, the core having voids and the shell being free from voids.

Voids include porosity and planar defects, such as cracks and cold shuts. Substantially free from voids means that the outer surface 28-X is capable of being plated and passing industry standard plating quality tests. In an exemplary embodiment, such as shown in FIG. 7, the core 14-7 includes voids 44-7, while the outer surface 28-7 of the shell 12-7 is free from voids.

In an exemplary embodiment, the tool (e.g., die or mold) in which the shell 14-X is formed is maintained at a temperature above room temperature, but the cast core 12-X is not preheated to the tool temperature before being placed in the tool. As a result, the temperature of the tool and the temperature of the metal alloy from which the shell 14-X is to be formed are increased above the temperatures that are suitable if the tool is empty (i.e., if there is no cast core 12-X in the tool). In an exemplary embodiment in which the core 12-X and the shell 14-X are formed from a zinc alloy, the temperature of the tool is increased by approximately forty degrees Fahrenheit (40° F.), and the temperature of the zinc alloy from which the shell 14-X is to be formed is increased by approximately ten degrees Fahrenheit (10° F.).

In a first exemplary embodiment shown in FIGS. 1*a*-1*e*, the faucet 10-1 includes a core 12-1 and a shell 14-1.

The core 12-1 is formed from a metal alloy, such as a zinc alloy. The core 12-1 has an inner surface 16-1 and an outer surface 18-1. The core 12-1 has an inlet 20-1 and an outlet 22-1. The core 12-1 has a passageway 24-1 extending from the inlet 20-1 to the outlet 22-1.

The shell 14-1 is formed from a metal alloy, such as a zinc alloy. The shell 14-1 is cast around the outer surface 18-1 of the core 12-1. The shell 14-1 has an inner surface 26-1 and an outer surface 28-1.

The core 12-1 includes two core components 32-1—a first core half 34-1 and a second core half 36-1. Each core component 32-1 is cast. The first core half 34-1 and the second core half 36-1 are mirror images of each other. The first core half 34-1 and the second core half 36-1 are operable to be joined together to form the core 12-1. The first core half 34-1 and the second core half 36-1 are joined together using any known technique such that the shell 14-1 does not penetrate the passageway 24-1 of the core 12-1 when the shell 14-1 is cast around the core 12-1.

In a second exemplary embodiment shown in FIGS. 2*a*-2*e*, the soap dispenser 10-2 includes a core 12-2 and a shell 14-2.

The core 12-2 is formed from a metal alloy, such as a zinc alloy. The core 12-2 has an inner surface 16-2 and an outer surface 18-2. The core 12-2 has an inlet 20-2 and an outlet 22-2. The core 12-2 has a passageway 24-2 extending from the inlet 20-2 to the outlet 22-2.

The shell 14-2 is formed from a metal alloy, such as a zinc alloy. The shell 14-2 is cast around the outer surface 18-2 of the core 12-2. The shell 14-2 has an inner surface 26-2 and an outer surface 28-2.

The core 12-2 includes two core components 32-2—a first core half 34-2 and a second core half 36-2. Each core component 32-2 is cast. The first core half 34-1 and the second core half 36-1 are mirror images of each other. The first core half 34-2 and the second core half 36-2 are operable to be joined together to form the core 12-2. The first core half 34-2 and the second core half 36-2 are joined together using any known technique such that the shell 14-2 does not penetrate the passageway 24-2 of the core 12-2 when the shell 14-2 is cast around the core 12-2.

In a third exemplary embodiment shown in FIGS. 3*a*-3*e*, the faucet 10-3 includes a core 12-3 and a shell 14-3.

The core 12-3 is formed from a metal alloy, such as a zinc alloy. The core 12-3 has an inner surface 16-3 and an outer surface 18-3. The core 12-3 has an inlet 20-3 and an outlet 22-3. The core 12-3 has a passageway 24-3 extending from the inlet 20-3 to the outlet 22-3.

The shell 14-3 is formed from a metal alloy, such as a zinc alloy. The shell 14-3 is cast around the outer surface 18-3 of the core 12-3. The shell 14-3 has an inner surface 26-3 and an outer surface 28-3.

The core 12-3 includes two core components 32-3. Each core component 32-3 is cast. The first core half 34-1 and the second core half 36-1 are not mirror images of each other. The two core components 32-3 are operable to be joined together to form the core 12-3. The two core components 32-3 are joined together using any known technique such that the shell 14-3 does not penetrate the passageway 24-3 of the core 12-3 when the shell 14-3 is cast around the core 12-3.

In a fourth exemplary embodiment shown in FIGS. 4*a*-4*d*, the faucet 10-4 includes a core 12-4 and a shell 14-4.

The core 12-4 is formed from a metal alloy, such as a copper alloy. The core 12-4 has an inner surface 16-4 and an outer surface 18-4. The core 12-4 has an inlet 20-4 and an outlet 22-4. The core 12-4 has a passageway 24-4 extending from the inlet 20-4 to the outlet 22-4.

The shell 14-4 is formed from a metal alloy, such as a zinc alloy. The shell 14-4 is cast around the outer surface 18-4 of the core 12-4. The shell 14-4 has an inner surface 26-4 and an outer surface 28-4.

The core 12-4 includes a unitary bent tube 42-4. The core 12-4 is formed by bending a unitary straight tube. The core metal alloy has a ductility. In an exemplary embodiment, the ductility of the core metal alloy enables the tube 42-4 to be bent.

Figure 5B:
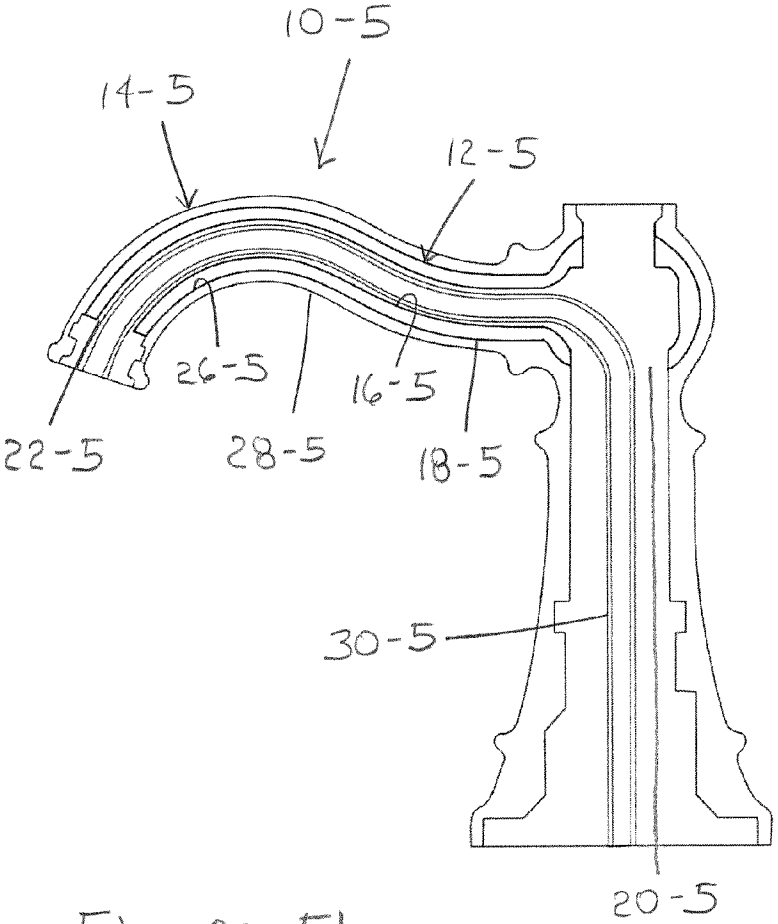
FIGS. 5*a*-5*b* are views of a soap dispenser including a core, a shell, and a liner according to a fifth exemplary embodiment of the present invention
Figure 5A:
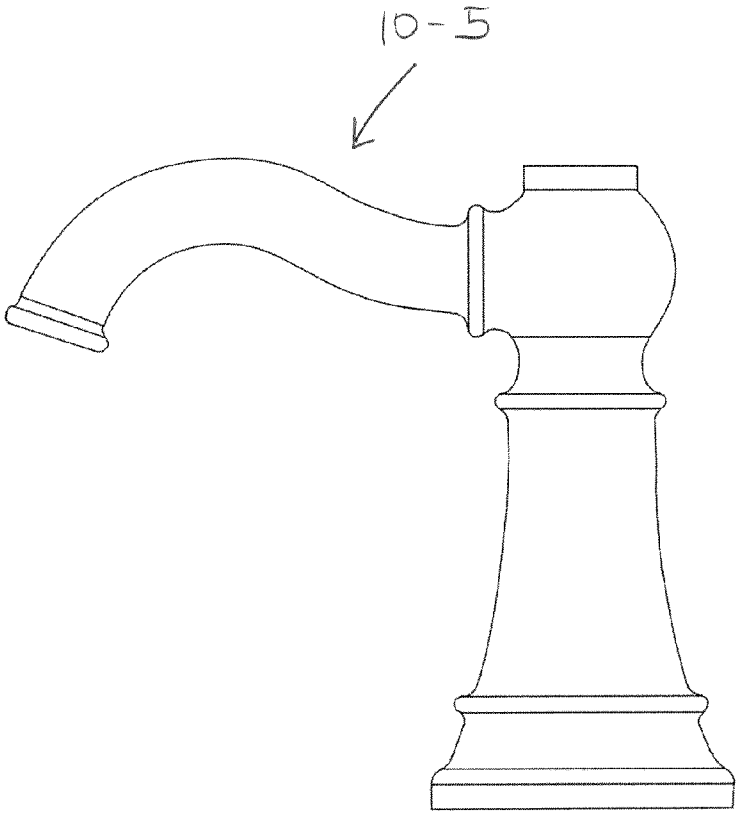

In a fifth exemplary embodiment shown in FIGS. 5*a*-5*b*, the soap dispenser 10-5 includes a core 12-5, a shell 14-5, and a liner 30-5.

The core 12-5 is formed from a metal alloy. The core 12-5 has an inner surface 16-5 and an outer surface 18-5. The core 12-5 has an inlet 20-5 and an outlet 22-5. The core 12-5 has a passageway 24-5 extending from the inlet 20-5 to the outlet 22-5.

The shell 14-5 is formed from a metal alloy. The shell 14-5 is cast around the outer surface 18-5 of the core 12-5. The shell 14-5 has an inner surface 26-5 and an outer surface 28-5.

The liner 30-5 is operable to prevent fluid flowing through the passageway 24-5 from contacting the inner surface 16-5 of the core 12-5. The liner 30-X is formed from a flexible material. In an exemplary embodiment, the liner is formed from a non-metal. The liner 30-5 is operable to be inserted in the passageway 24-5 of the core 12-5.

In the illustrated embodiments, the core 12-X includes structure that extends outside of the shell 14-X before finishing of the fluid dispensing apparatus 10-X. This structure is used to place and retain the core 12-X in the tool and is removed during finishing of the fluid dispensing apparatus 10-X.

One of ordinary skill in the art will now appreciate that the present invention provides a fluid dispensing apparatus and a method of manufacturing a fluid dispensing apparatus. Although the present invention has been shown and described with reference to particular embodiments, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. A fluid dispensing apparatus, comprising: an apparatus inlet through which fluid is received into the apparatus; an apparatus outlet through which fluid is dispensed from the apparatus; an apparatus passageway extending from the apparatus inlet to the apparatus outlet; a core, the core being formed from a metal alloy, the core metal alloy having a melting point, the core having an inner surface and an outer surface, the core having a core inlet and a core outlet, the core having a core passageway extending from the core inlet to the core outlet; and a shell, the shell being formed from a metal alloy, the shell metal alloy having a melting point, the shell being cast around the outer surface of the core, the shell being in direct contact with the outer surface of the core;

wherein, as cast, at least one of: the core inlet is coextensive with the apparatus inlet, and the core outlet is coextensive with the apparatus outlet; and wherein the melting point of the core metal alloy is approximately the same as the melting point of the shell metal alloy.

2. The fluid dispensing apparatus of claim 1, wherein the solidus of the core is within fifty degrees Fahrenheit of the solidus of the shell.

3. The fluid dispensing apparatus of claim 1, wherein the solidus of the core is within one hundred degrees Fahrenheit of the liquidus of the shell.

4. The fluid dispensing apparatus of claim 1, further including:

a liner, the liner being formed from a flexible material, the liner being operable to prevent fluid flowing through the core passageway from contacting the inner surface of the core.

5. The fluid dispensing apparatus of claim 1, wherein:

the core has a thickness;

the shell has a thickness; and around a substantial portion of the outer surface of the core, the thickness of the shell is less than the thickness of the core.

6. The fluid dispensing apparatus of claim 1, wherein:

the shell has an outer surface; and the outer surface of the shell is substantially free from voids.

7. The fluid dispensing apparatus of claim 1, wherein:

the core includes a plurality of cast core components joined together to form the core.

8. The fluid dispensing apparatus of claim 7, wherein:

the core includes a first core half and a second core half joined together to form the core.

9. The fluid dispensing apparatus of claim 8, wherein:

the first core half includes a groove;

the second core half includes a tongue; and the groove of the first core half is operable to receive the tongue of the second core half to join together the first core half and the second core half.

10. The fluid dispensing apparatus of claim 1, wherein:

the core metal alloy is a zinc alloy; and the shell metal alloy is a zinc alloy.

11. The fluid dispensing apparatus of claim 1, wherein, as cast: the core outlet is coextensive with the apparatus outlet.

12. The fluid dispensing apparatus of claim 1, wherein, as cast: the core inlet is coextensive with the apparatus inlet; and the core outlet is coextensive with the apparatus outlet.

13. A method of manufacturing a fluid dispensing apparatus, comprising the steps of: forming an apparatus passageway having an apparatus inlet and an apparatus outlet, fluid being received into the apparatus through the apparatus inlet, fluid being dispensed from the apparatus through the apparatus outlet, the apparatus passageway extending from the apparatus inlet to the apparatus outlet; wherein the step of forming the apparatus passageway includes at least the steps of: forming a core, the core being formed from a metal alloy, the core metal alloy having a melting point, the core having an inner surface and an outer surface, the core having a core inlet and a core outlet, the core having a core passageway extending from the core inlet to the core outlet; and casting a shell around the outer surface of the core, the shell being in direct contact with the outer surface of the core, the shell being formed from a metal alloy, the shell metal alloy having a melting point;

wherein, as cast, at least one of: the core inlet is coextensive with the apparatus inlet, and the core outlet is coextensive with the apparatus outlet; and wherein the melting point of the core metal alloy is approximately the same as the melting point of the shell metal alloy.

14. The method of claim 13, wherein the solidus of the core is within fifty degrees Fahrenheit of the solidus of the shell.

15. The method of claim 13, wherein the solidus of the core is within one hundred degrees Fahrenheit of the liquidus of the shell.

16. The method of claim 13, further including the step of:

providing a liner in the passageway of the core, the liner being formed from a flexible material, the liner being operable to prevent fluid flowing through the core passageway from contacting the inner surface of the core.

17. The method of claim 13, wherein:

the core has a thickness;

the shell has a thickness; and around a substantial portion of the outer surface of the core, the thickness of the shell is less than the thickness of the core.

18. The method of claim 13, wherein:

the shell has an outer surface; and the outer surface of the shell is substantially free from voids.

19. The method of claim 13, wherein:

the step of forming the core includes the steps of casting a plurality of core components and joining together the plurality of core components.

20. The fluid dispensing apparatus of claim 13, wherein, as cast: the core outlet is coextensive with the apparatus outlet.

21. The fluid dispensing apparatus of claim 13, wherein, as cast: the core inlet is coextensive with the apparatus inlet; and the core outlet is coextensive with the apparatus outlet.

* * * * *